US009735479B2

(12) United States Patent
Chen et al.

(10) Patent No.: US 9,735,479 B2
(45) Date of Patent: Aug. 15, 2017

(54) SINGLE ELEMENT WIRE TO BOARD CONNECTOR TERMINAL

(71) Applicant: Tarng Yu Enterprise co.,ltd, New Taipei (TW)

(72) Inventors: Tsung-Chi Chen, New Taipei (TW); Mu-Jung Huang, New Taipei (TW)

(73) Assignee: TARNG YU ENTERPRISE CO., LTD, New Taipei (TW)

( * ) Notice: Subject to any disclaimer, the term of this patent is extended or adjusted under 35 U.S.C. 154(b) by 0 days.

(21) Appl. No.: 15/294,542

(22) Filed: Oct. 14, 2016

(65) Prior Publication Data

US 2017/0110807 A1 Apr. 20, 2017

(30) Foreign Application Priority Data

Oct. 16, 2015 (TW) ..... 104216617 U

(51) Int. Cl.
*H01R 4/48* (2006.01)
*H01R 12/57* (2011.01)

(52) U.S. Cl.
CPC ..... *H01R 4/48* (2013.01); *H01R 4/4818* (2013.01); *H01R 12/57* (2013.01)

(58) Field of Classification Search
CPC ..... H01R 4/48; H01R 12/57; H01R 4/4818; H01R 4/4827; H01R 4/4836; H01R 4/4845; H01R 13/187
USPC ..... 439/834, 437, 438, 441, 835, 843, 852
See application file for complete search history.

(56) References Cited

U.S. PATENT DOCUMENTS 8,303,343 B2 * 11/2012 Nagata ..... H01R 13/6461 439/607.54
8,550,838 B2 * 10/2013 Osagle ..... H01R 4/4818 439/441
8,968,022 B2 * 3/2015 Mostoller ..... H01R 4/4836 439/438
9,306,297 B2 * 4/2016 Bishop ..... H01R 4/4818
9,472,871 B2 * 10/2016 Lin ..... H01R 4/4836
9,543,682 B2 * 1/2017 Jin ..... H01R 4/4836
9,548,564 B2 * 1/2017 Wu ..... H01R 4/4836

FOREIGN PATENT DOCUMENTS

KR WO 2014160998 A1 * 10/2014 ..... H01R 4/4836

* cited by examiner

*Primary Examiner* — Tulsidas C Patel
*Assistant Examiner* — Travis Chambers
(74) *Attorney, Agent, or Firm* — Chun-Ming Shih

(57) ABSTRACT

A single element wire to board connector terminal for clamping a conductor, includes: a base, side plates and hanging elastic arms. A hollow passage is formed on the base, for allowing the conductor to pass through the hollow passage. The side plates are bent and provided on two opposite sides of a front part of the base. The hanging elastic arms are extended backwardly and inwardly from the side plates respectively. An elastic arm restricting portion is extended from one of the hanging elastic arms and bent transversely, for protecting the elastic arm and providing access for the conductor. A conductor positioning portion is provided on a rear part of the base.

13 Claims, 11 Drawing Sheets

SINGLE ELEMENT WIRE TO BOARD CONNECTOR TERMINAL

CROSS-REFERENCE TO RELATED APPLICATIONS

This application claims the priority of Republic of China Patent Application No. 104216617 filed on Oct. 16, 2015, in the State Intellectual Property Office of the R.O.C., the disclosure of which is incorporated herein by reference.

BACKGROUND OF THE INVENTION

Field of the Invention

The invention relates to single element wire to board connector terminals, and more particularly, to a connector for electrically connecting a conductor to a circuit board.

Descriptions of the Related Art

A conventional wire to board connector terminal, particularly for connecting a conductive wire to an electronic element, is provided with an insulating housing on its terminal cover, for protecting the wire and the terminal against dust and moisture. The insulating housing is also for preventing multiple terminals when being provided from being situated too closely or from interfering with each other due to large potential difference. The terminals are used to connect metallic conductive wires (so-called electrical wires) between electronic elements, or to connect conductive wires between an electronic element and a circuit board. The electronic element includes resistance, capacitance, inductance, LED, transformer, LCD panel, touch panel, and so on. With the connector terminals being provided, power or electronic signals can be transmitted through the conductive wires to accomplish installation and arrangement for and between electronic products, internal circuit boards in electronic equipment and electronic elements.

However, not all the electronic products require the above connector terminal having the insulating housing and provision of the multiple terminals in consideration of an operating environment and structural configuration thereof. For example, for a thin electronic product having spatial limitations, the insulating housing mounted outside the terminal would restrict the design on overall height of the electronic product, while providing the multiple terminals would undesirably widen the electronic product. The use of the insulating housing undoubtedly increases costs of making the electronic element, and applying the multiple terminals having insulating housings to unipolar conduction is undesirably spatially ineffective and cost-ineffective.

Therefore, how to make a new connector terminal in order to solve the above problems of the conventional technology is an important topic in the art.

SUMMARY OF THE INVENTION

Therefore, in view of the above drawbacks of the conventional wire to board connector terminal, a single element wire to board connector terminal and an electrical connector having the single element wire to board connector terminal are provided in the invention.

A primary object of the invention is to provide a single element wire to board connector terminal, without using a conventional insulating housing. The terminal is provided individually or mounted on another device. The single element wire to board connector terminal includes a base, two side plates and two hanging elastic arms. A hollow passage is formed on the base, for allowing a conductor to pass through the hollow passage. The side plates are bent and provided on two opposite sides of a front part of the base. The hanging elastic arms are extended backwardly and inwardly from the side plates respectively. An elastic arm restricting portion is extended from one of the hanging elastic arms, for preventing the elastic arm from over stretching. When the conductor has been inserted into the hollow passage and clamped by the hanging elastic arms in position, if a user wishes to detach the conductor from the hanging elastic arms, the elastic arm restricting portion can be pressed to have the hanging elastic arm deformed outwardly such that the conductor is released from the clamping by the hanging elastic arms, wherein the elastic arm restricting portion may also limit deformation of the hanging elastic arm. Thereby the invention has several advantages, such as reducing costs, easy operation, preventing over-deformation, and decrease in size.

Another object of the invention is to provide a single element wire to board connector terminal, wherein the elastic arm restricting portion is formed with a tongue extended backwardly and downwardly, or a stop portion is extended forwardly and upwardly from a clamping portion, so as to prevent the conductor from escape through a top gap. An elastic arm positioning portion is provided between the hanging elastic arms, for making the hanging elastic arms aligned and guiding the conductor. A conductor positioning portion is connected to the base, and includes a conductor stop surface vertical to the base and three stop plates extended from left, right and top sides of the conductor stop surface, so as to prevent the conductor from being over inserted, tilted or improperly clamped at a wrong position, such that the conductor can be guided correctly to a predetermined position without being detached or tilted.

BRIEF DESCRIPTION OF THE DRAWINGS

The above and other aspects, features and other advantages of the present invention will be more clearly understood from the following detailed description taken in conjunction with the accompanying drawings, in which.

DETAILED DESCRIPTION OF THE PREFERRED EMBODIMENT

Figure 1:
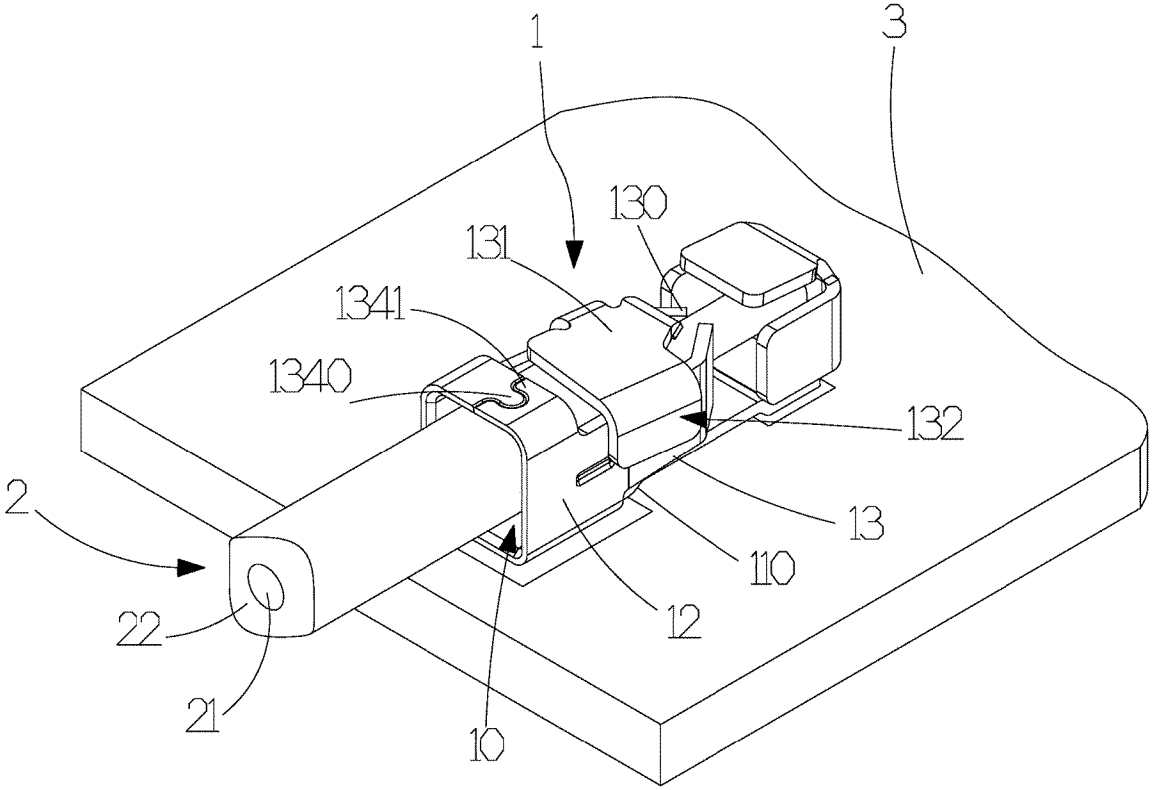
FIG. 1 is a schematic diagram showing a three-dimensional view of a wire to board connector terminal according to a first preferred embodiment of the invention.

Embodiments of the present invention will now be described in detail with reference to the accompanying drawings. The invention may, however, be embodied in many different forms and should not be construed as being limited to the embodiments set forth herein. Rather, these embodiments are provided so that this disclosure will be thorough and complete, and will fully convey the scope of the invention to those skilled in the art. In the drawings, the shapes and dimensions of elements may be exaggerated for clarity, and the same reference numerals will be used throughout to designate the same or like components.

Figure 2:
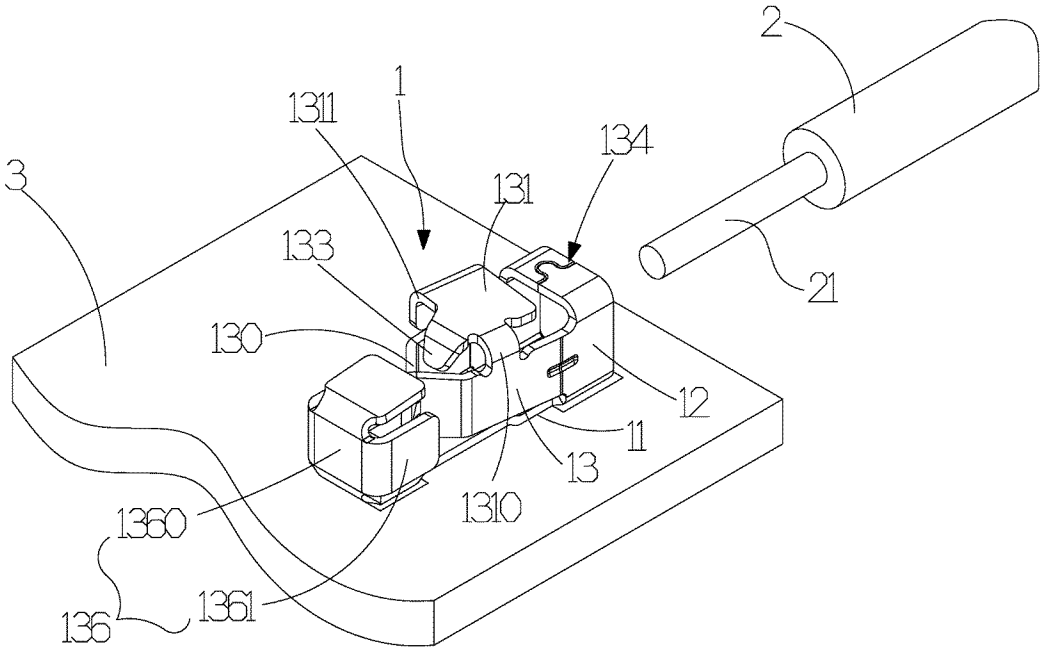
FIG. 2 is a schematic diagram showing another three-dimensional view of the wire to board connector terminal according to the first preferred embodiment of the invention.
Figure 3:
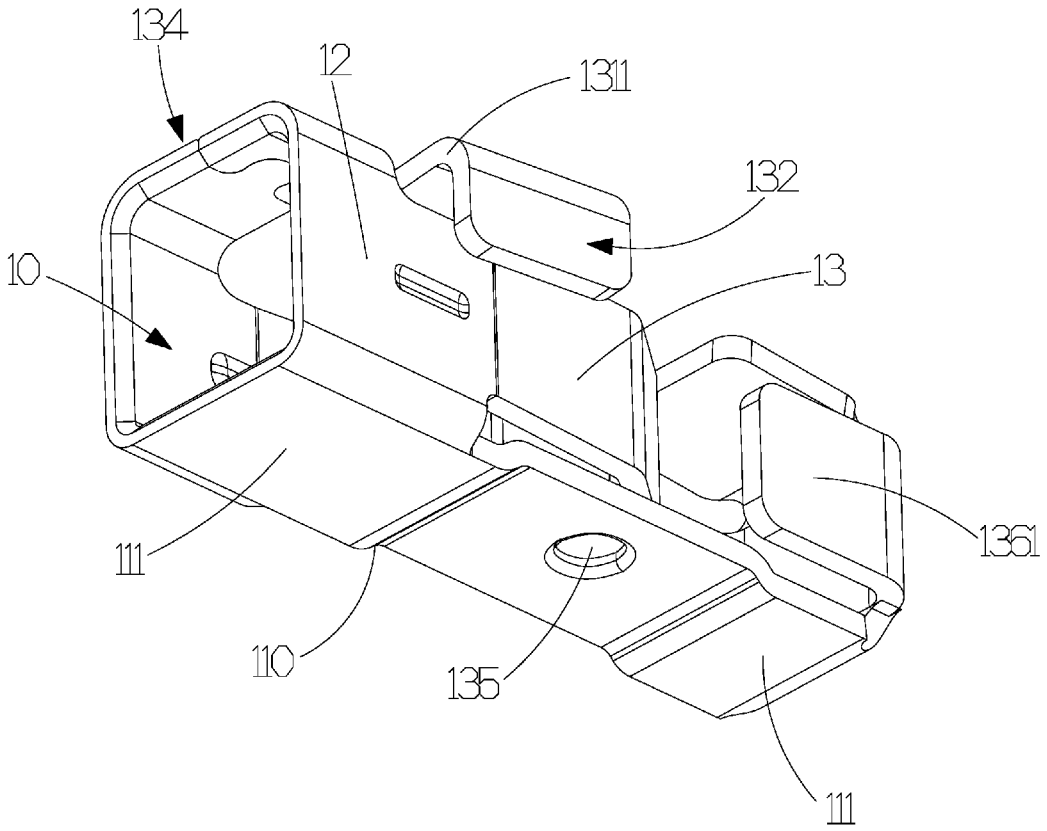
FIG. 3 is a schematic diagram showing another three-dimensional view of the wire to board connector terminal according to the first preferred embodiment of the invention.
Figure 4:
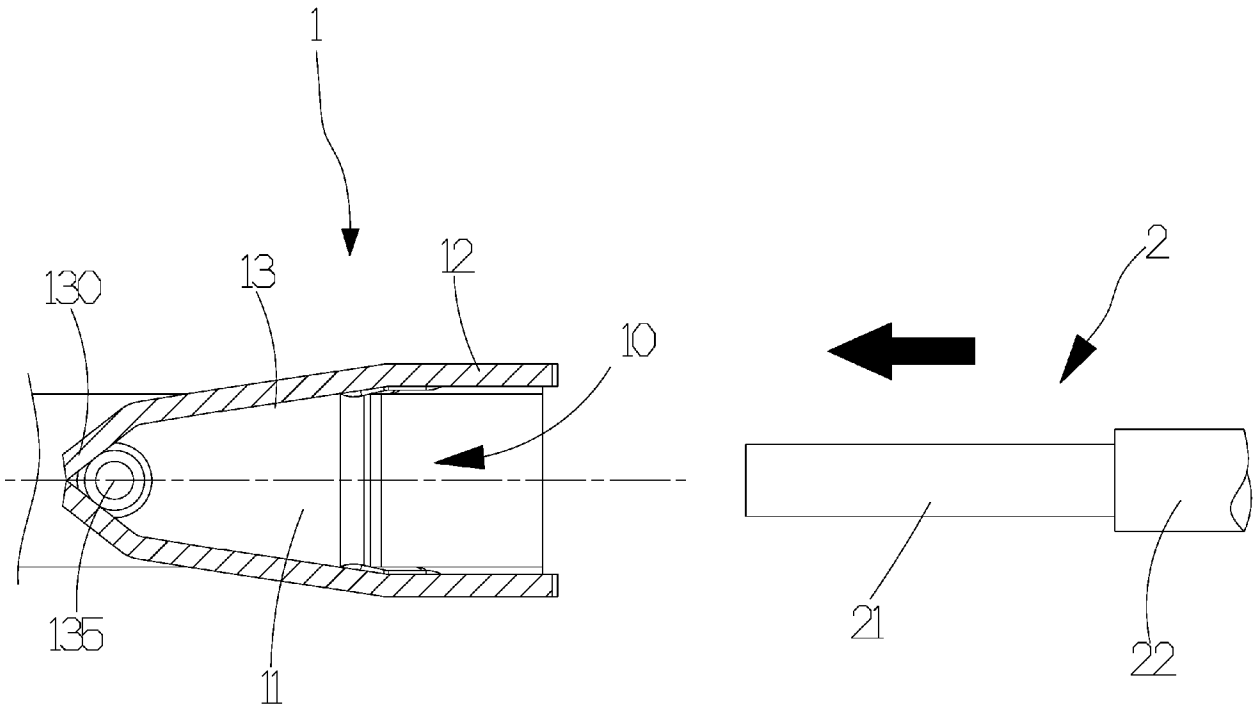
FIG. 4 is a schematic diagram showing a side cross-sectional view of the wire to board connector terminal according to the first preferred embodiment of the invention.
Figure 5:
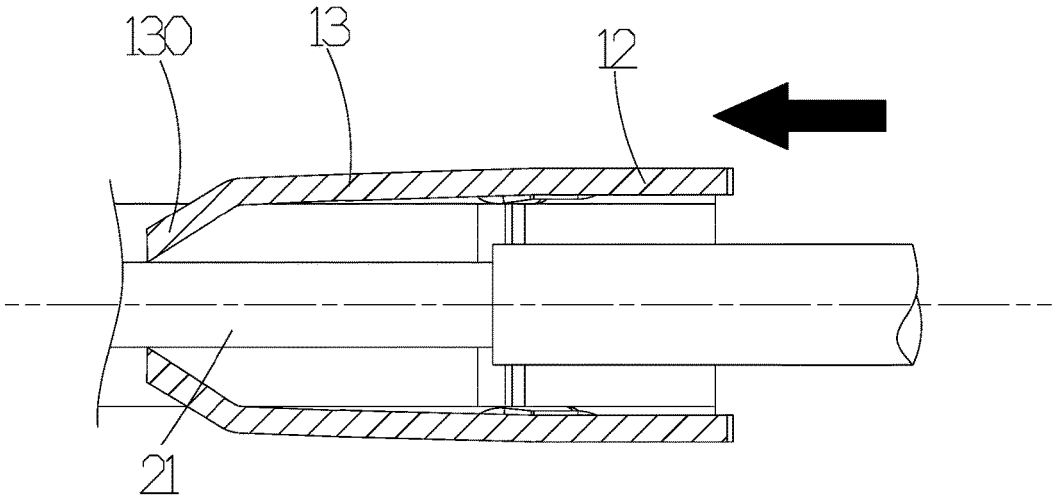
FIG. 5 is a schematic diagram showing another side cross-sectional view of the wire to board connector terminal according to the first preferred embodiment of the invention.
Figure 6:
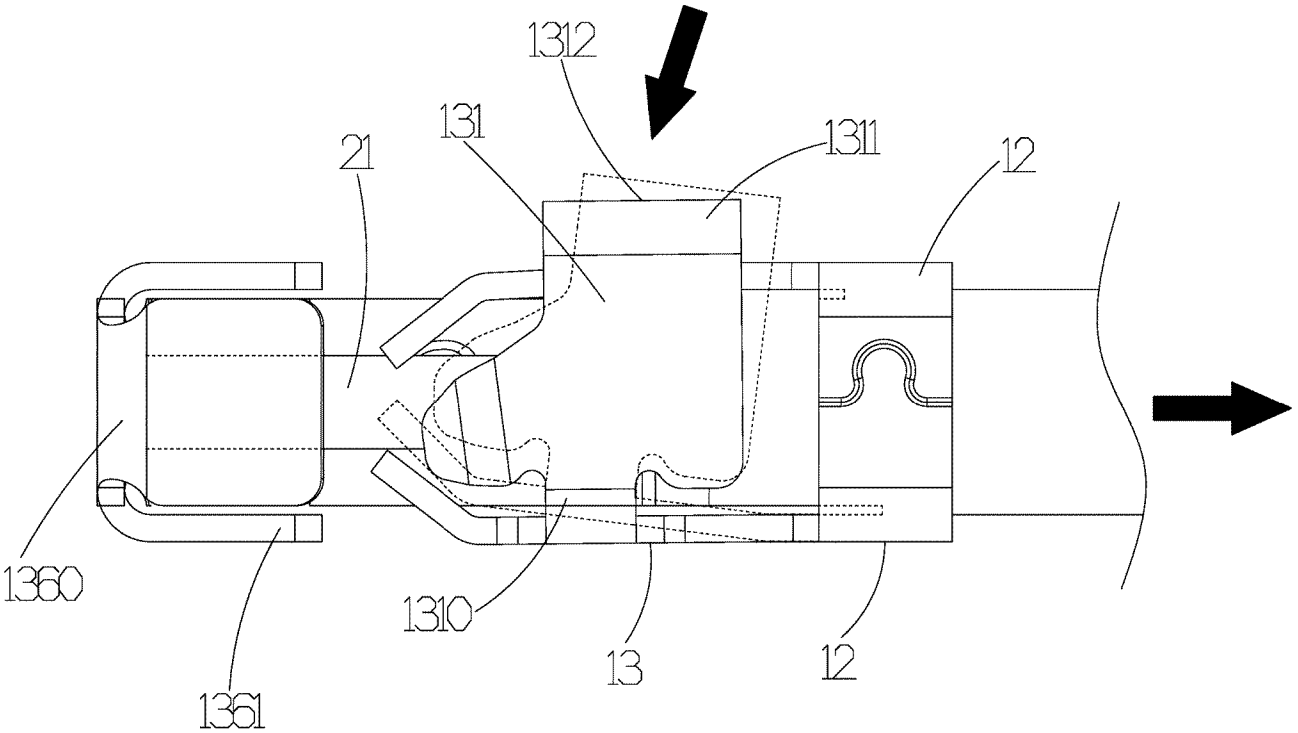
FIG. 6 is a schematic diagram showing a top view of the wire to board connector terminal according to the first preferred embodiment of the invention.

FIGS. 1, 2 and 3 are three-dimensional views made from different perspectives of view for a single element wire to board connector terminal 1 according to a first preferred embodiment of the invention. As shown in the figures, the single element wire to board connector terminal 1 is mounted on a preset circuit board 3, for clamping a wire 2. It includes a base 11, side plates 12 and hanging elastic arms 13.

The base 11 of the single element wire to board connector terminal 1 is provided with a hollow passage 10 thereon. The base 11 has a middle part protruded upwardly to form a step 110 connected to a front part and a rear part of the base 11 respectively. A welding portion 111 is formed at each of the front and rear parts of the base 11. The side plates 12 are bent and provided on two opposite sides of the front part of the base 11, and the hanging elastic arms 13 are protruded horizontally from the side plates 12 towards the rear part of the base 11. The two side plates 2 have different lengths along the base 11 longitudinally, and so do the two hanging elastic arms 13. Each of the hanging elastic arms 13 has a clamping portion 130 at a rear end thereof, and one of them has an elastic arm restricting portion 131, wherein the elastic arm restricting portion 131 is extended transversely from the hanging elastic arm 13 and bent downwardly to form an inverted U shape. The elastic arm restricting portion 131 is formed with a fixed end 1310 in conjunction with the hanging elastic arm 13 and a free end 1311 opposite to the fixed end 1310, the free end 1311 having a pressing portion 132. The elastic arm restricting portion 131 further has a tongue 133 extended backwardly and downwardly. The two side plates 12 are bent at upper ends thereof to form a convex portion 1340 and a concave portion 1341 respectively, wherein the convex portion 1340 is engaged with the concave portion 1341 to form a top plate 134 connecting the two side plates 12. On the base 11 there is provided an elastic arm positioning portion 135 between the hanging elastic arms 13, allowing inner sides of the hanging elastic arms 13 to elastically abut against the elastic arm positioning portion 135. On the rear part of the base 11 there is provided a conductor positioning portion 136 connected to the base 11. The conductor positioning portion 136 includes a conductor stop surface 1360 vertical to the base 11, and stop plates 1361 extended from left, right and top sides of the conductor stop surface 1360, so as to form a box-like structure for preventing a central conductor 21 from escape.

The wire 2 is made of the central conductor 21 covered with an insulating layer 22. The wire 2 may also simply be a common central conductor 21 having electrical conductivity, such as plug conductive sheet or conductive terminal. This kind of modification is only the matter of choice and should be included in the claimed invention.

FIGS. 2, 3, 4, 5 and 6 are different three-dimensional views, side cross-sectional views and a top view of the single element wire to board connector terminal according to the first embodiment of the invention. As shown in the figures, in operation, a preferred embodiment of the invention is to mount the single element wire to board connector terminal 1 on a circuit board 3 via the welding portions 111 of the wire to board connector terminal 1, and have the wire 2 penetrate through the hollow passage 10 of the base 11 of the wire to board connector terminal 1, with the central conductor 21 of the wire 2 entering the hollow passage 10 of the wire to board connector terminal 1 and sequentially pushing against the tongue 133 on the elastic arm restricting portion 131 of the elastic arm 13 and the two clamping portions 130 connected to the side plates 12 to make them deformed outwardly. The free end 1311 of the elastic arm restricting portion 131 has an inner surface abut against an outer surface of the other hanging elastic arm 13, making this hanging elastic arm 13 deformed to a predetermined extent in order not to over stretch the hanging elastic arm 13 and go beyond the yield point thereof to cause undesirable deformation of the hanging elastic arm 13. At a position on the base 11 between the hanging elastic arms 13 close to the clamping portions 130 there is provided the elastic arm positioning portion 135 for holding the clamping portions 130 on the hanging elastic arms 13 at preferable predetermined positions, wherein the preferable predetermined positions refer to the positions in a gap between the two clamping portions 130 and close to an axial center of the base 11, such that the central conductor 21 may be clamped and positioned properly in multiple directions by means of the restoring elastic force of the tongue 133 and the two clamping portions 130, so as to achieve multiple electrical connection contacts between the wire to board connector terminal 1 and the central conductor 21. The elastic arm positioning portion 135 prevents the central conductor 21 of the wire 2, when being inserted to the hollow passage 10, from detachment due to insufficient insertion depth thereof caused by positional deviation of the hanging elastic arm 13. In this embodiment the elastic arm positioning portion 135 is a round protrusion having a semi-circular vertical cross-section. It should also be understood that, the elastic arm positioning portion 135 may be an upwardly protruded prism having a transverse cross-section of circle, oval, rhombus or any other shape (not shown), or it can be an upwardly protruded pyramid having a transverse cross-section of circle, oval, rhombus or any other shape (not shown). The central conductor 21 being inserted to the hollow passage 10 is aligned correctly by the above mentioned structure. The conductor positioning portion 136 on the rear part of the base 11, the conductor stop surface 1360, and the stop plates 1361 extended from left, right and top sides of the conductor stop surface 1360, together form the box-like structure for preventing the central conductor 21 from escape. This thereby fix the central conductor 21 in position from multiple directions and assure its insertion depth in a manner to prevent any part of the central conductor 21 from being detached out of the terminal 1.

When a user wishes to remove the central conductor 21, he/she may apply a pushing force on the pressing portion 132 provided at the free end 1311 of the elastic arm restricting portion 131, making the hanging elastic arm 13 connected to the fixed end 1310 of the elastic arm restricting portion 131 become outwardly deformed. The two side plates 2 have different lengths along the base 11 longitudinally, and so do the two hanging elastic arms 13 extended from the side plates 2, such that the hanging elastic arms 13 and the side plates 2 have different fulcrums of deformation, and the hanging elastic arm 13 with the elastic arm restricting portion 131 has more deformation than the other hanging elastic arm 13. This allows the clamping portions 130, which is for clamping open and close, to be in a released status by which the central conductor 21 can be detached from the connector terminal 1.

Figure 7:
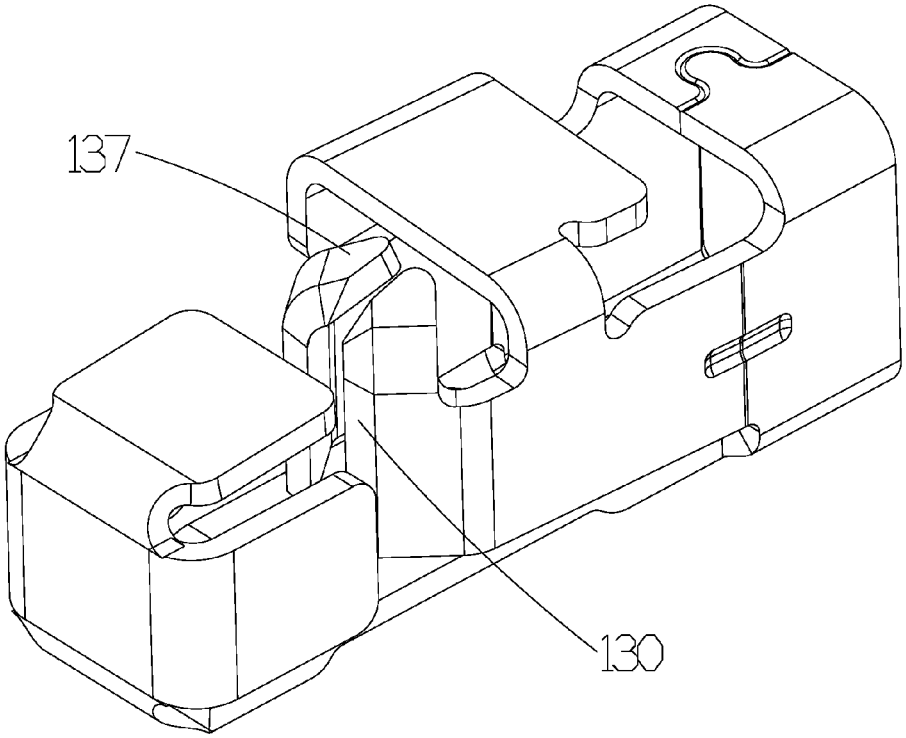
FIG. 7 is a schematic diagram showing a three-dimensional view of a wire to board connector terminal according to a second preferred embodiment of the invention.

Referring to FIGS. 2 and 7, which are respectively another three-dimensional view of the wire to board connector terminal according to the first preferred embodiment of the invention and a three-dimensional view of a wire to board connector terminal according to a second preferred embodiment of the invention, the second preferred embodiment differs from the first preferred embodiment in that, there is no tongue 133 formed on the elastic arm restricting portion 131 in the second embodiment. In the second embodiment, stop portions 137 are provided on the clamping portions 130 and extended forwardly and upwardly, for preventing the central conductor 21 from escape through a gap at the top and also for direction guiding use.

Figure 8:
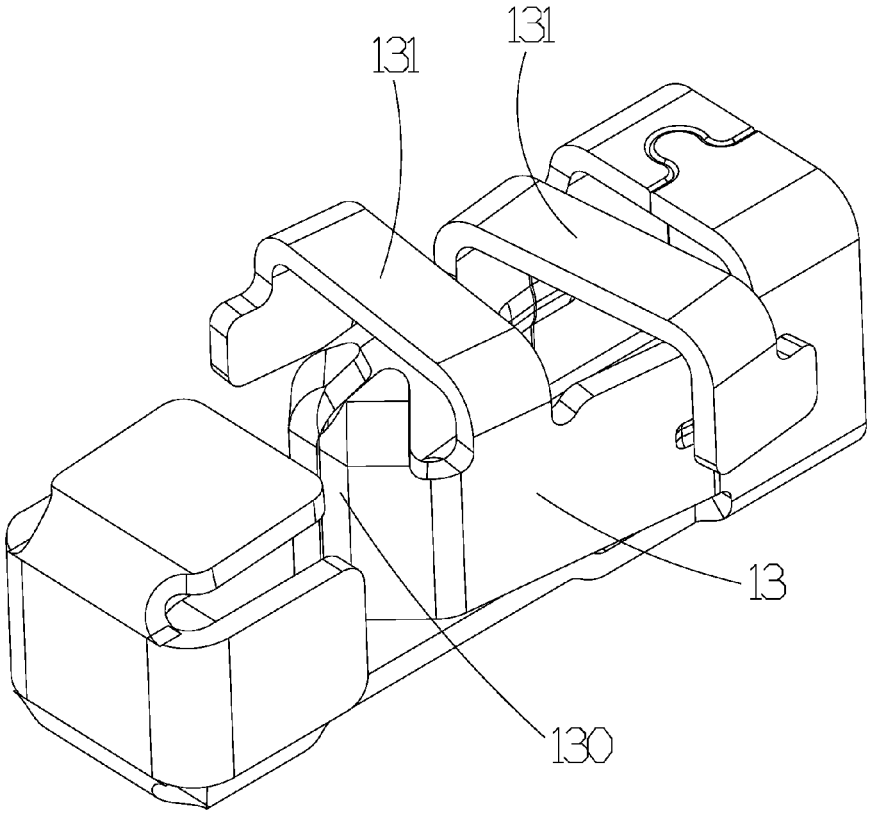
FIG. 8 is a schematic diagram showing a three-dimensional view of a wire to board connector terminal according to a third preferred embodiment of the invention.

Referring to FIGS. 7 and 8, which are respectively a three-dimensional view of the wire to board connector terminal according to the second preferred embodiment of the invention and a three-dimensional view of a wire to board connector terminal according to a third preferred embodiment of the invention, the difference between these two embodiments is that, only one of the hanging elastic arms 13 has the elastic arm restricting portion 131 in the second preferred embodiment, while in the third preferred embodiment, both the hanging elastic arms 13 may be formed with elastic arm restricting portions 131. In the third embodiment, the two elastic arm restricting portions 131 make the clamping portions 130 of the hanging elastic arms 13 elastically deformed transversely in a manner to enlarge an opening between the clamping portions 130 and allow the central conductor (not shown) to be detached therefrom. It should be noted that, the number of elastic arm restricting portions 131 in the third embodiment is not limited to one or two but can be more.

Figure 9:
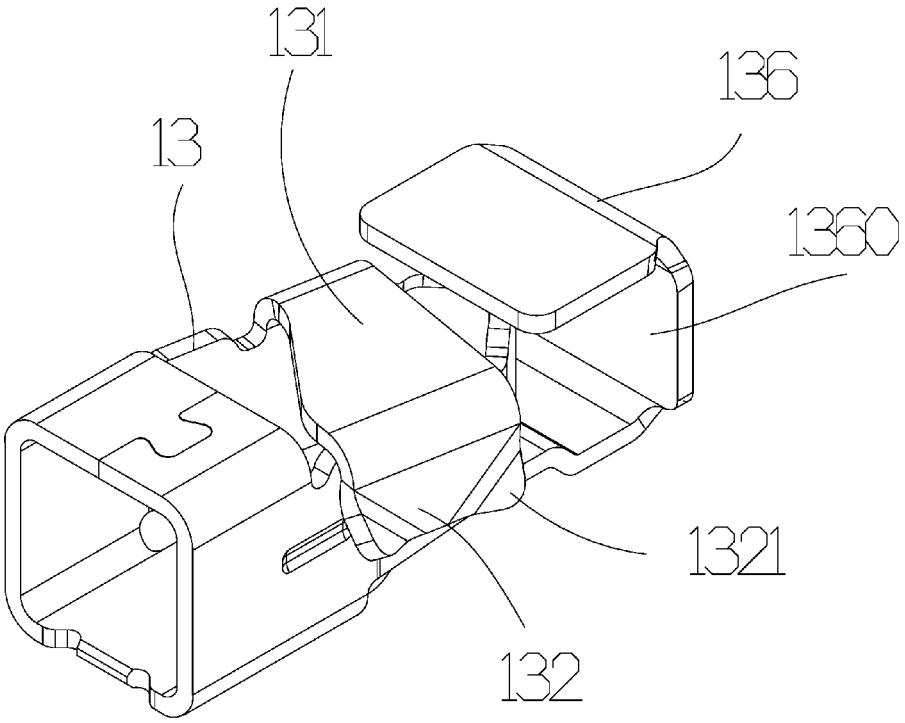
FIG. 9 is a schematic diagram showing a three-dimensional view of a wire to board connector terminal according to a fourth preferred embodiment of the invention.
Figure 10:
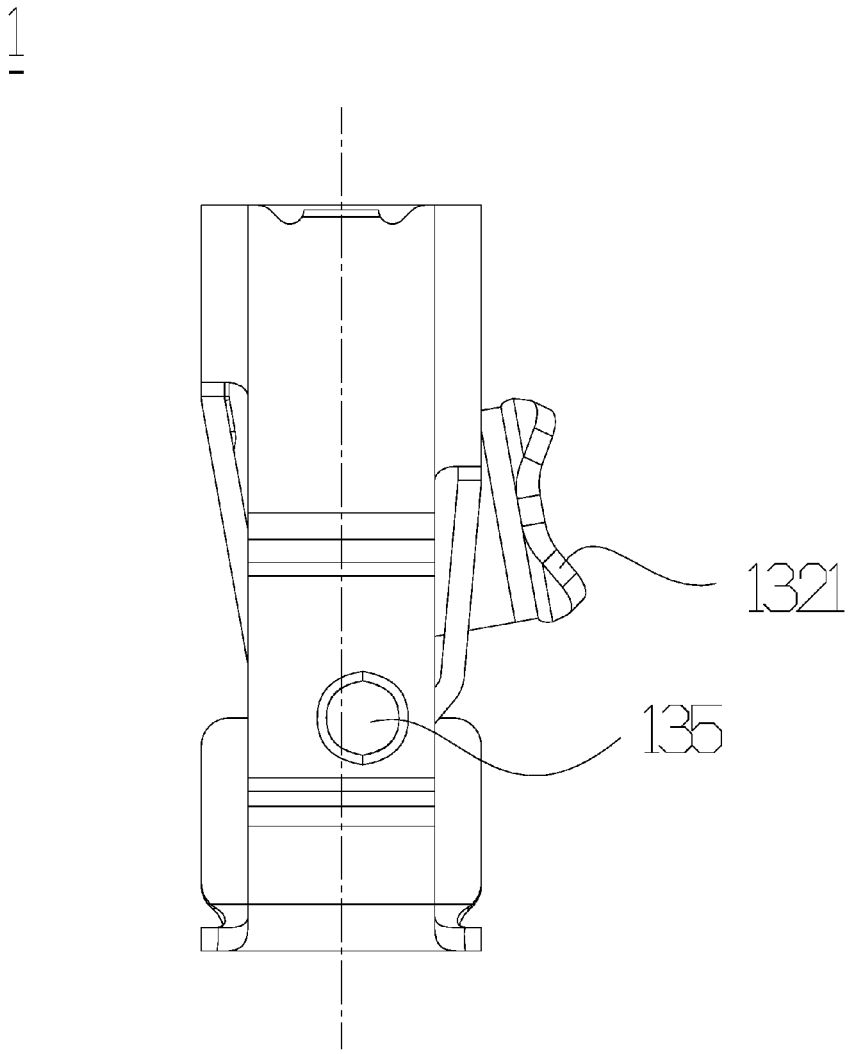
FIG. 10 is a schematic diagram showing a cross-sectional view of the wire to board connector terminal according to the fourth preferred embodiment of the invention.

Referring to FIGS. 9 and 10, which are respectively a three-dimensional view and a cross-sectional view of a wire to board connector terminal according to a fourth preferred embodiment of the invention. In this embodiment, the pressing portion 312 is formed with a warping structure 1321 for sustaining a pressing force, which helps the user press the pressing portion 132 and controls deformation of the hanging elastic arm 13 connected to the elastic arm restricting portion 131 to a predetermined extent. Further in this embodiment, the elastic arm positioning portion 135 is formed at a position deviated from a central line of the base 11.

Figure 11:
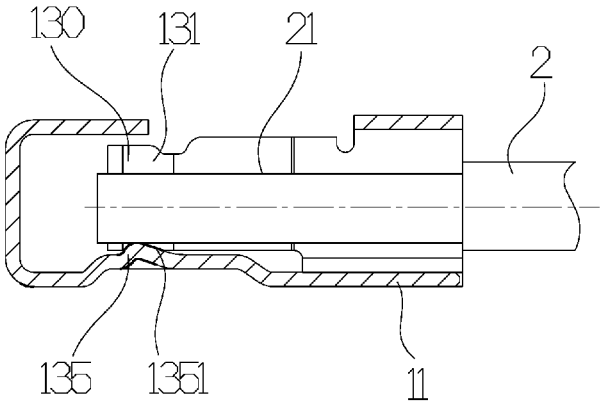
FIG. 11 is a schematic diagram showing the action of an elastic arm positioning portion according to the invention.

Further regarding the elastic arm positioning portion 135, as shown in FIG. 11, it is protruded upwardly to form a guiding surface 1351 for guiding the central conductor 21 of the wire 2 into the opening between the clamping portions 130 of the hanging elastic arms 13, so as to avoid unclamping and improper positioning of the central conductor 21 if it is not held within the opening between the clamping portions 130.

Figure 12:
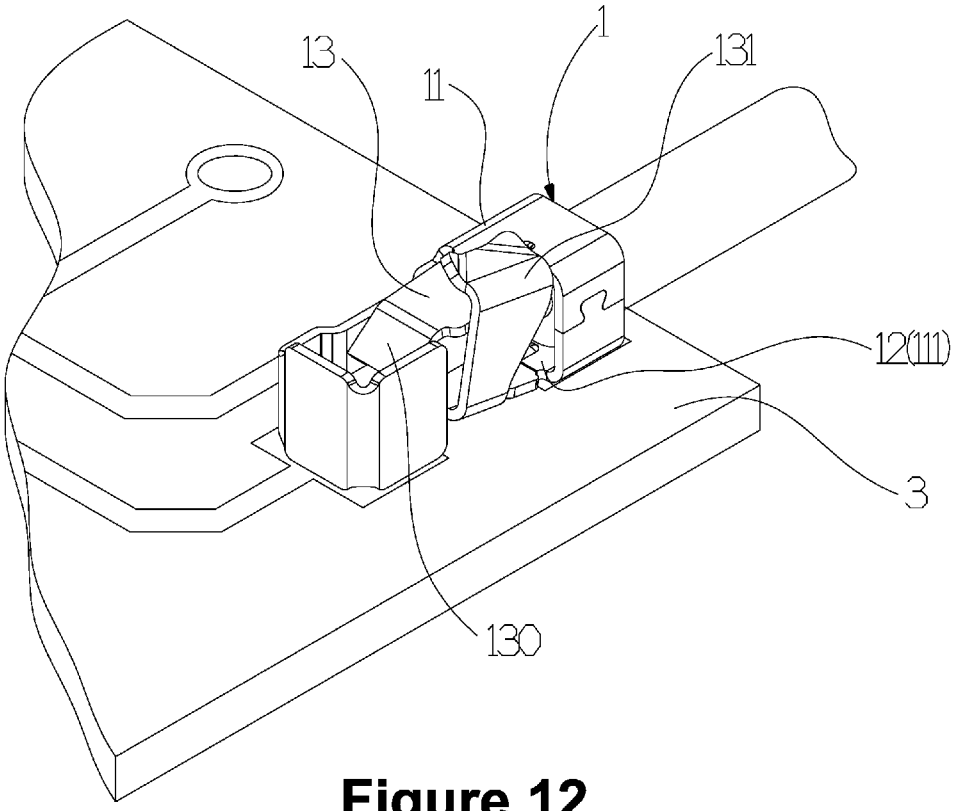
FIG. 12 is a schematic diagram showing a three-dimensional view of a wire to board connector terminal according to a fifth preferred embodiment of the invention.

Referring to FIG. 12, which is a three-dimensional view of a wire to board connector terminal according to a fifth preferred embodiment of the invention, in this embodiment one of the two side plates 12 is formed with a welding portion 111 for mounting the wire to board connector terminal 1 on a circuit board 3.

Therefore, the single element wire to board connector terminal of the invention as described above solves the problems of the conventional technology and does have patentable features.

The examples above are only illustrative to explain principles and effects of the invention, but not to limit the invention. It will be apparent to those skilled in the art that modifications and variations can be made without departing from the scope of the invention. Therefore, the protection range of the rights of the invention should be as defined by the appended claims.

What is claimed is:

1. A single element wire to board connector terminal for clamping a conductor, including:

a base formed with a hollow passage thereon for allowing the conductor to pass through the hollow passage;

two side plates bent and provided on two opposite sides of a front part of the base; and a first and a second hanging elastic arms and a conductor positioning portion, wherein the first and the second hanging elastic arms are extended backwardly and inwardly from the two side plates respectively, a first elastic arm restricting portion is extended from the first hanging elastic arm and bent transversely towards, above and beyond the second hanging elastic arm, and the conductor positioning portion is provided on a rear part of the base.

2. The single element wire to board connector terminal according to claim 1, wherein the first elastic arm restricting portion is formed with a tongue extended backwardly and downwardly.

3. The single element wire to board connector terminal according to claim 1, wherein each of the first and the second hanging elastic arms is formed with a clamping portion for clamping the conductor, and a stop portion extended forwardly and upwardly from the clamping portion.

4. The single element wire to board connector terminal according to claim 1, wherein the two side plates have different lengths along the base longitudinally, and the first and the second hanging elastic arms have different lengths along the base longitudinally.

5. The single element wire to board connector terminal according to claim 1, wherein the two side plates are bent at upper ends thereof to form a convex portion and a concave portion respectively, and the convex portion is engaged with the concave portion to form a top plate connecting the two side plates.

6. The single element wire to board connector terminal according to claim 1, wherein one of the two side plates is formed with a welding portion.

7. The single element wire to board connector terminal according to claim 1, wherein the second hanging elastic arm is formed with a second elastic arm restricting portion bent transversely towards, above and beyond the first hanging elastic arm, so when the conductor passes through the hollow passage and pushes on the first and the second hanging elastic arms, the first and the second hanging elastic arms are respectively and independently deformed outwards.

8. The single element wire to board connector terminal according to claim 7, wherein the first and the second hanging elastic arms is formed with a clamping portion for clamping the conductor, and a stop portion extended forwardly and upwardly from the clamping portion.

9. The single element wire to board connector terminal according to claim 1, wherein the first elastic arm restricting portion is further extended and bent downwardly to form an inverted U shape, and the first elastic arm restricting portion has a fixed end in conjunction with the first hanging elastic arm and a free end opposite to the fixed end, the free end having a pressing portion.

10. The single element wire to board connector terminal according to claim 9, wherein the pressing portion has a warping structure for sustaining a pressing force applied on the pressing portion so as to allow deformation of the first hanging elastic arm in conjunction with the first elastic arm restricting portion to be controlled.

11. A single element wire to board connector terminal for clamping a conductor, including:

a base formed with a hollow passage thereon for allowing the conductor to pass through the hollow passage;

two side plates bent and provided on two opposite sides of a front part of the base; and two hanging elastic arms, an elastic arm restricting portion and a conductor positioning portion, wherein the two hanging elastic arms are extended backwardly and inwardly from the two side plates respectively, the elastic arm restricting portion is extended from one of the two hanging elastic arms and bent transversely, and the conductor positioning portion is provided on a rear part of the base, wherein the base has a middle part protruded upwardly and is formed with a welding portion at each of the front and rear parts thereof, and an elastic arm positioning portion is provided on the base and between the two hanging elastic arms.

12. The single element wire to board connector terminal according to claim 11, wherein the elastic arm positioning portion is provided at a position deviated from a central line of the base.

13. A single element wire to board connector terminal for clamping a conductor, including:

a base formed with a hollow passage thereon for allowing the conductor to pass through the hollow passage;

two side plates bent and provided on two opposite sides of a front part of the base; and two hanging elastic arms, an elastic arm restricting portion and a conductor positioning portion, wherein the two hanging elastic arms are extended backwardly and inwardly from the two side plates respectively, the elastic arm restricting portion is extended from one of the two hanging elastic arms and bent transversely, and the conductor positioning portion is provided on a rear part of the base, wherein the conductor positioning portion is connected to the base, and includes a conductor stop surface vertical to the base and three stop plates extended from left, right and top sides of the conductor stop surface so as to form a box-like structure for preventing the conductor from escape.

* * * * *